United States Patent [19]

Tanaka

[11] 4,206,775

[45] Jun. 10, 1980

[54] COIN SORTING MACHINE

[75] Inventor: Akio Tanaka, Kawasaki, Japan

[73] Assignee: Fuji Electric Co., Ltd., Kawasaki, Japan

[21] Appl. No.: 917,429

[22] Filed: Jun. 20, 1978

[30] Foreign Application Priority Data

Jun. 21, 1977 [JP] Japan ..... 52-73726

[51] Int. Cl.[2] ..... G07D 5/00; G07F 3/02

[52] U.S. Cl. ..... 133/3 R; 194/100 A; 73/163

[58] Field of Search ..... 194/99, 100 R, 100 A; 209/571; 324/234, DIG. 1; 133/3 R; 73/163

[56] References Cited

U.S. PATENT DOCUMENTS

| | | | |
|---|---|---|---|
| 2,992,731 | 7/1961 | Edelman | 209/571 |
| 3,152,677 | 10/1964 | Phillips | 194/100 R |
| 3,278,839 | 10/1966 | Wells et al. | 324/234 X |
| 3,576,244 | 4/1971 | Ptacek et al. | 194/100 A |
| 3,653,481 | 4/1972 | Boxall et al. | 194/100 A |
| 3,869,663 | 3/1975 | Tschierse | 194/100 A X |

*Primary Examiner*—Robert J. Spar
*Assistant Examiner*—Edward M. Wacyra
*Attorney, Agent, or Firm*—Sughrue, Rothwell, Mion, Zinn & Macpeak

[57] ABSTRACT

A coin sorting machine uses a plurality of impedance bridges each including an impedance element corresponding to a particular coin denomination and an element whose impedance is varied by the passage of a coin. The AC signal output from each bridge is compared to a reference level and the comparator output is then compared to a square wave having a period equal to that of the AC bridge excitation signal. When a bridge becomes balanced due to the passage of its particular coin, the comparator output will maintain one value for a time exceeding one period of the excitation signal and a coin can thereby be identified.

5 Claims, 8 Drawing Figures

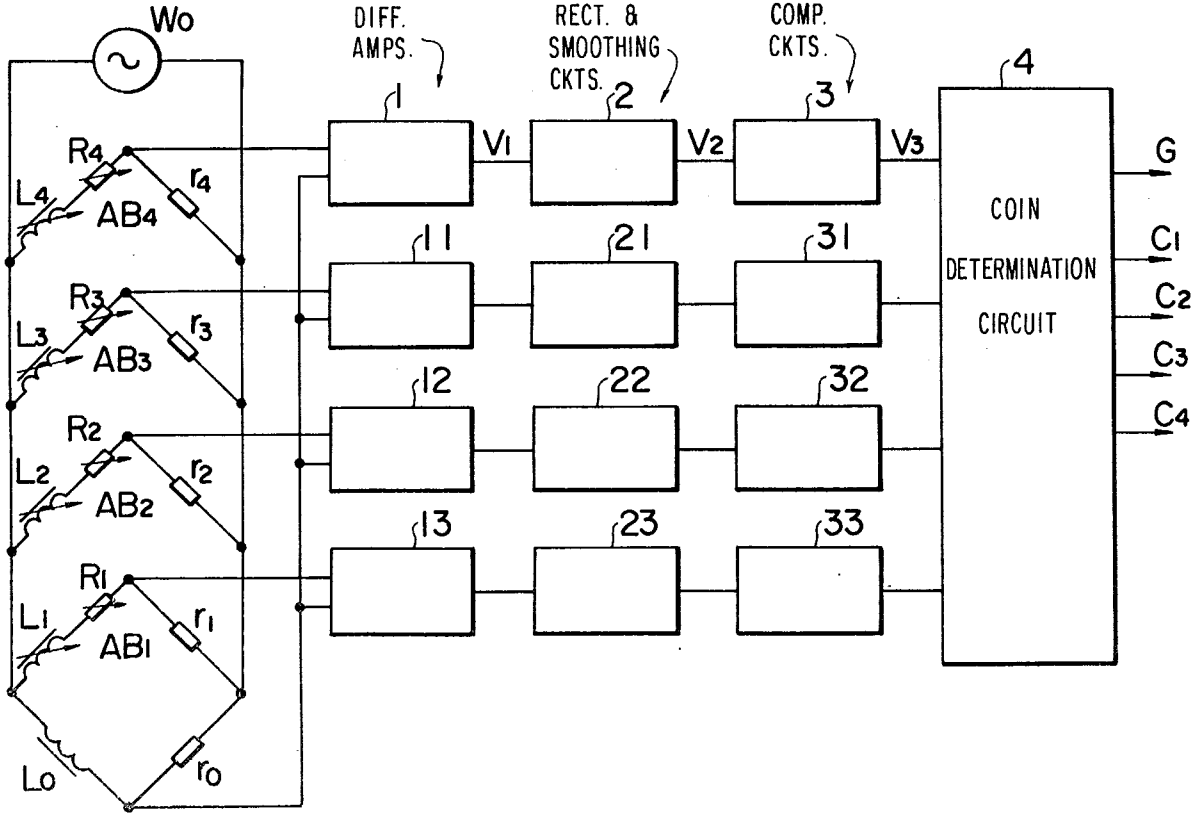
FIG. 1_PRIOR ART

FIG. 2 _ PRIOR ART

COIN SORTING MACHINE

BACKGROUND OF THE INVENTION

This invention relates to an improvement in a coin sorting machine in which a bridge circuit is formed with a sorting coil, arranged along a coin passageway, and a standard impedance element, and the balance of the bridge circuit which occurs upon passage of a coin is detected to sort out coins.

A typical one of the conventional coin sorting machine of this type is as shown in FIG. 1.

In FIG. 1, reference characters AB1 through AB4 designate bridge circuits which are formed with a sorting coil Lo whose impedance is varied when a coin inserted into the machine passes therethrough, variable coils $L_1$ through $L_4$ adapted as standard impedance elements corresponding to the monetary denominations of coins to be sorted out and variable resistors $R_1$ through $R_4$; reference character Wo, an oscillation source; reference numerals 1, 11, 12 and 13, differential amplifiers; reference numerals 2, 21, 22 and 23, rectifying and smoothing circuits; reference numerals 3, 31, 32 and 33, comparison circuits; and reference numeral 4, a determination circuit. The number of denominations of coins to be sorted out is four in the coin sorting machine shown in FIG. 1.

When no coin is inserted into the machine, the outputs of the bridge circuits AB1 through AB4 applied to the differential amplifier circuits 1, 11, 12 and 13 are high, unbalance voltages.

When a coin is inserted to pass through the sorting coil Lo, the inductance of the sorting coil Lo is changed and, in response to this inductance change, only the bridge circuit corresponding to the denomination of the coin is balanced. The output of that bridge circuit is subjected to differential amplification in the respective differential amplifier circuit, and is then rectified and smoothed by the respective rectifying and smoothing circuit. The output thus treated is applied to the respective comparison circuit, where it is compared with a reference voltage to detect the balance of the bridge circuit. The output $V_1$ of the differential amplifier circuit, the output $V_2$ of the rectifying and smoothing circuit, and the output $V_3$ of the comparison circuit in this case are indicated by $V_1$, $V_2$ and $V_3$ in FIG. 2, respectively.

The output of the comparison circuit is applied to the determination circuit 4, where it is stored. In the determination circuit, a coin signal ($C_1$, $C_2$, $C_3$ or $C_4$) corresponding to the denomination of the inserted coin, and a gate signal G for segregating a true coin from a false coin are outputted.

In the above-described machine, at least three (3) amplifiers for differential amplification, rectifying and smoothing, and comparison are required for one denomination; and, accordingly, twelve amplifiers in total are required for sorting out coins of four different denominations. Thus, the conventional coin sorting machine is disadvantageous in that its manufacturing cost is expensive, and the space occupied by the circuit is relatively large. Furthermore, in order to reduce the manufacturing cost as much as possible, it is necessary to eliminate the expensive analog circuits which are disadvantageous in miniaturization.

It is also possible that the input $V_2$ of the comparison circuit 3 may vary around the reference voltage. In this case, the output $V_3$ of the comparison circuit is varied.

In order to overcome this difficulty, heretofore a voltage hysteresis is given to the comparison circuit as indicated by $V_2$ in FIG. 2 to achieve, in effect, a two-level comparison. In this case,, however, if the input $V_2$ of the comparison circuit becomes even slightly lower than the reference voltage, then the sorting signal will be immediately outputted and may be in error.

SUMMARY OF THE INVENTION

It is, therefore, an object of this invention to provide a coin sorting machine in which the above-described drawbacks accompanying a conventional coin sorting machine are eliminated, and its manufacturing cost is reduced without decreasing the coin sorting accuracy.

The foregoing object and other objects of the invention have been achieved by the provision of a coin sorting machine in which a bridge circuit is made up of a sorting coil whose impedance is varied by the passing of a coin, and a standard impedance element corresponding to the monetary denomination of a coin, and the output of the bridge circuit which is balanced when a coin is passed through the sorting coil is detected to sort out coins. The machine is so designed that a bridge output pulse train signal having binary codes obtained by comparing a signal which is obtained by amplifying the bridge output with a reference voltage in a comparison circuit is compared with a reference pulse train signal having the same period as that of an alternating current signal produced by an oscillation source provided for the bridge circuit, and when one binary code predetermined for the bridge output pulse train signal does not occur within at least one period of the reference pulse train signal, it is determined that the bridge circuit is balanced.

In order to prevent false indications, a hysteresis effect can be provided for both the commencement and termination of the coin sorting signal by requiring that each occur for a predetermined number of periods of the reference pulse train.

BRIEF DESCRIPTION OF THE DRAWINGS

FIG. 1 is an explanatory diagram showing essential components of a conventional coin sorting machine;

DETAILED DESCRIPTION OF THE INVENTION

Figure 2:
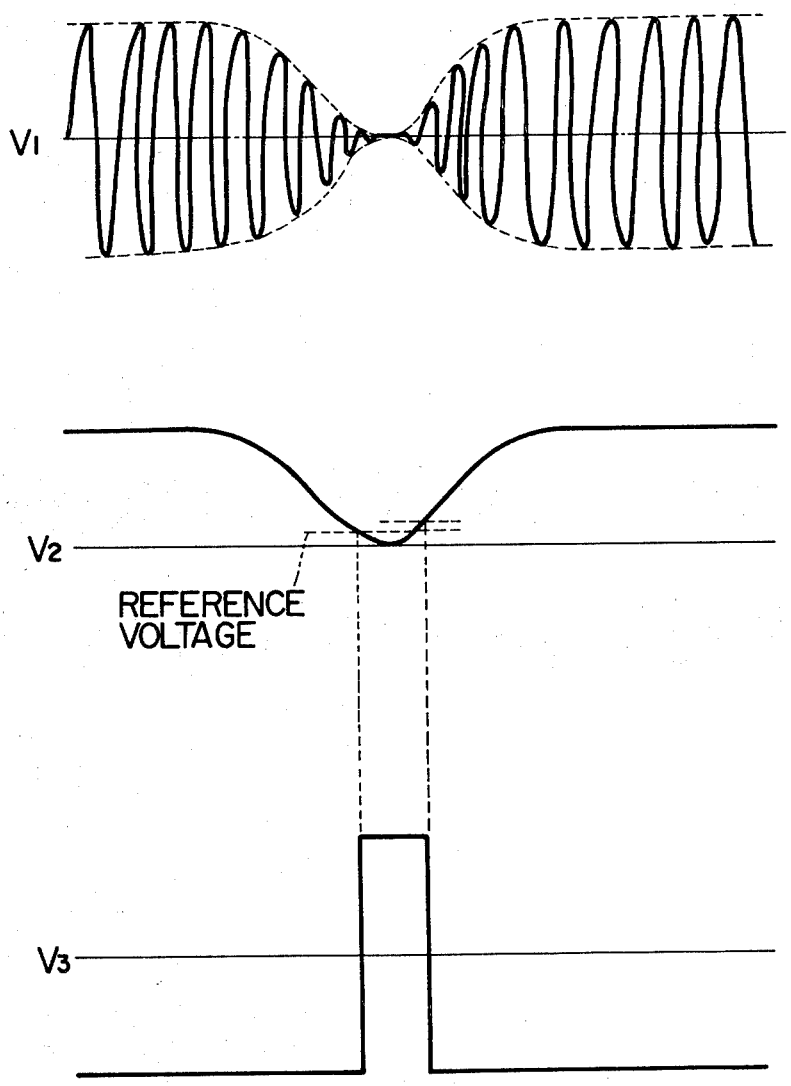
FIG. 2 contains waveform diagrams illustrating the operation of the machine of FIG. 1.
Figure 3:
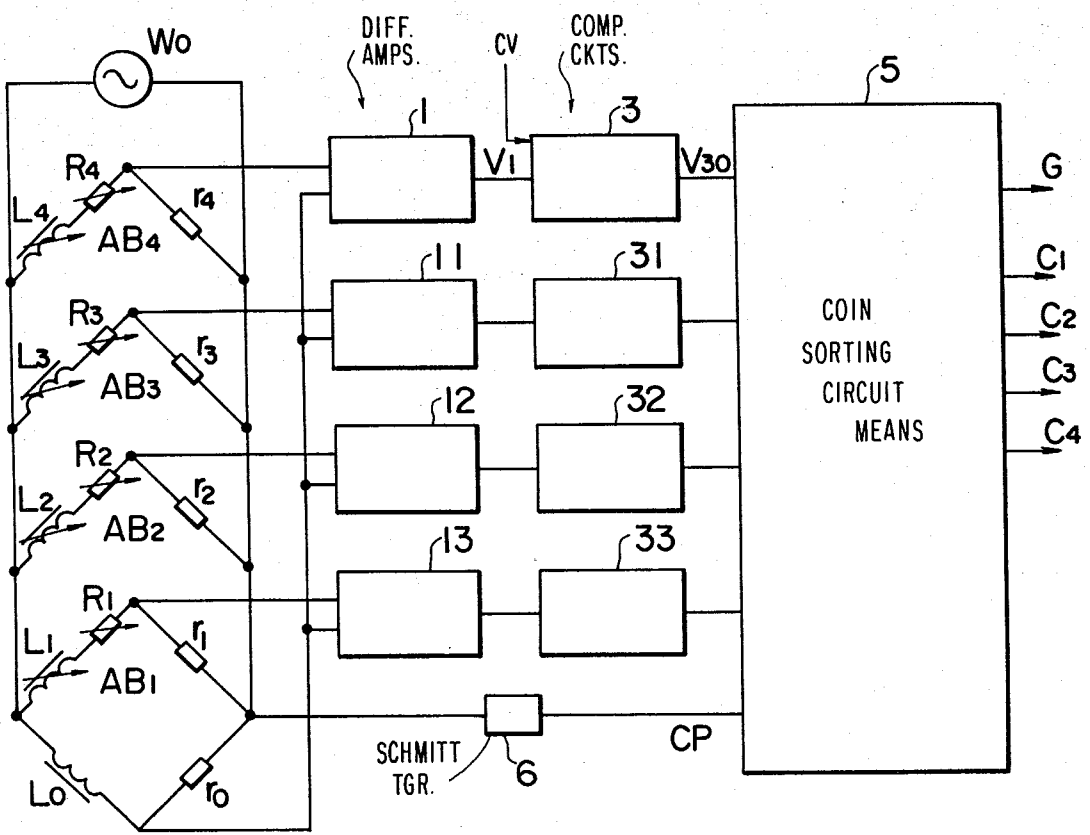
FIG. 3 is an explanatory diagram showing one embodiment of the invention.
Figure 4:
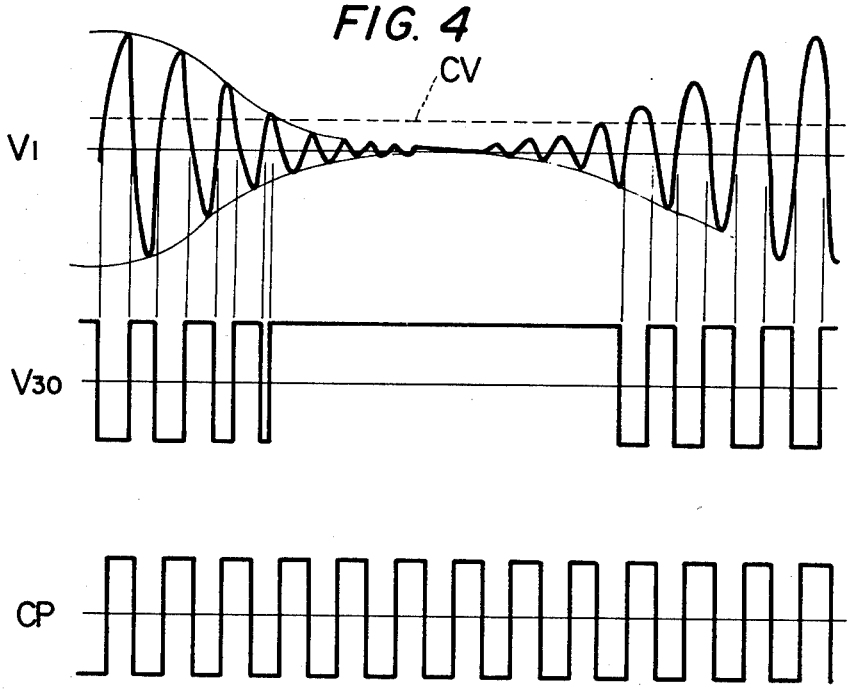
FIG. 4 contains waveform diagrams illustrating the operation of the machine of FIG. 3.
Figure 5:
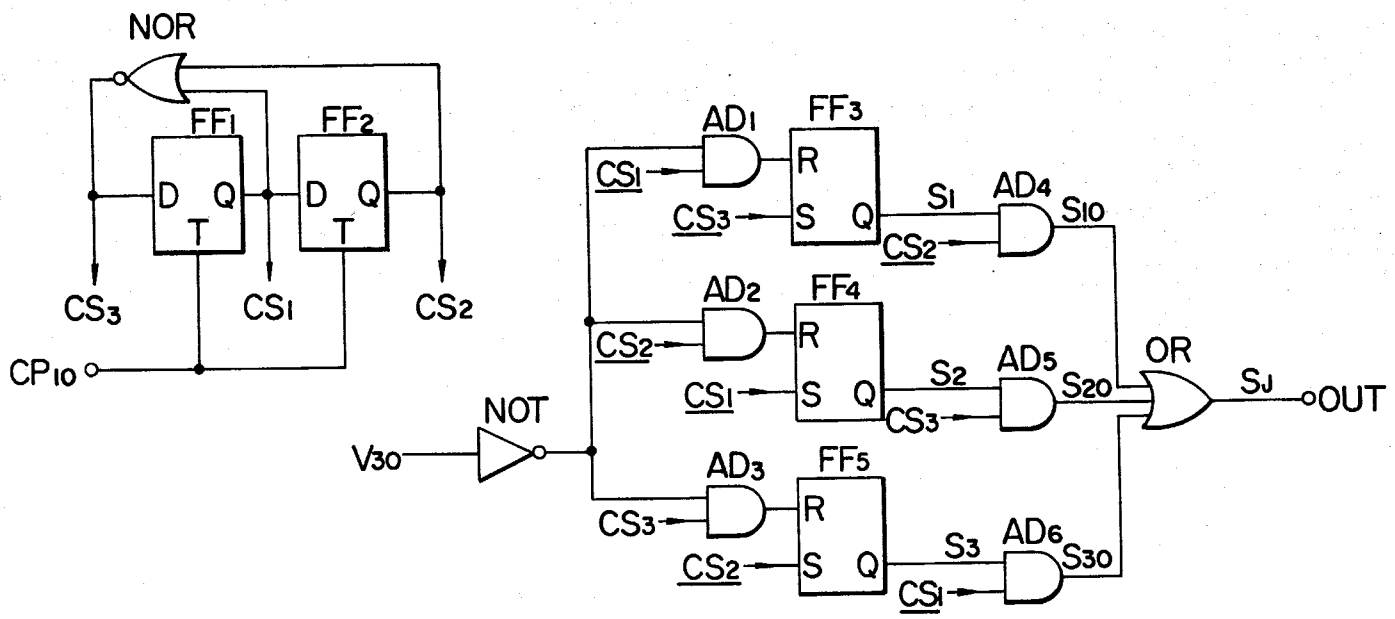
FIG. 5 is a circuit diagram illustrating the sorting circuit of FIG. 3.
Figure 6:
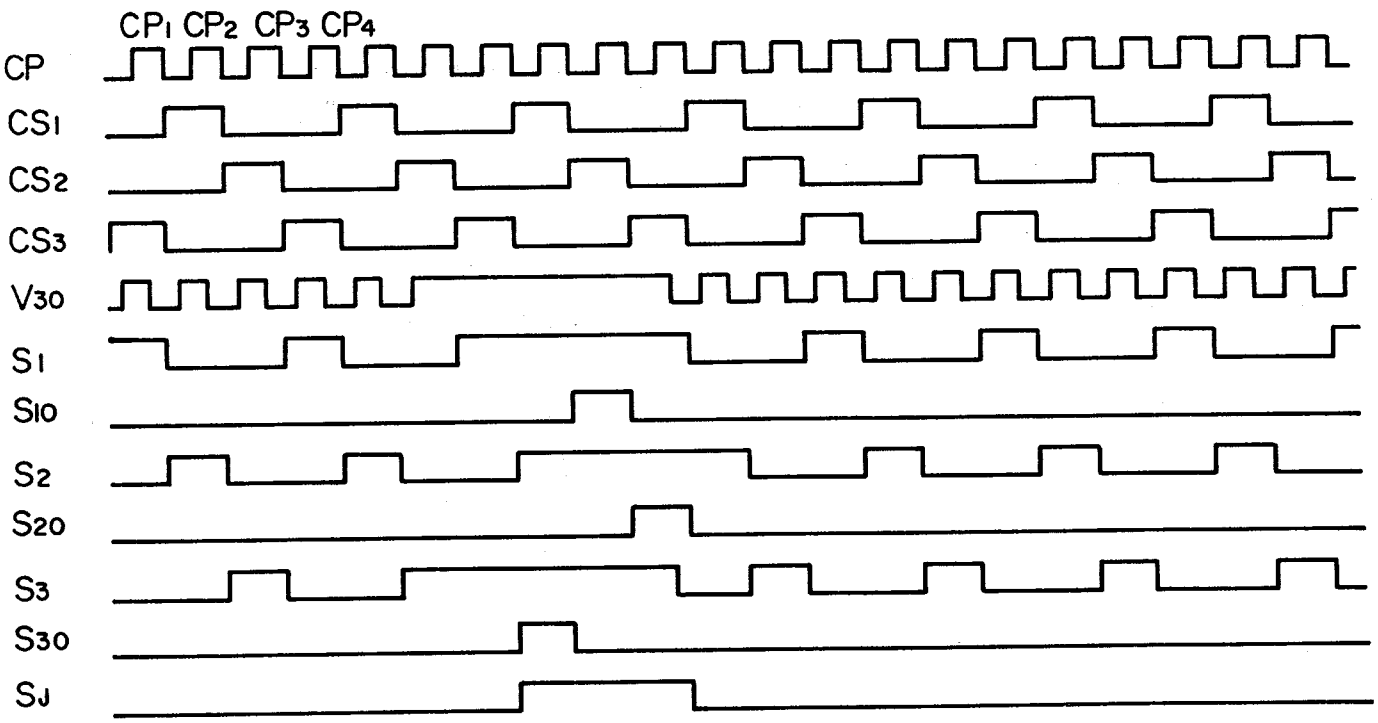
FIG. 6 contains waveform diagrams illustrating the operation of the circuit of FIG. 5.

One embodiment of the invention will be described with reference to FIGS. 3 to 6. FIG. 3 is a block diagram showing the arrangement of the embodiment of the invention. FIG. 5 is also a block diagram showing a control circuit employed in the embodiment. FIGS. 4 and 6 are waveform diagrams for a description of the embodiment of the invention. In FIG. 3, those components which have been described with reference to FIG. 1 are designated with like reference characters or numerals.

Referring to FIG. 3, the outputs of bridge circuits $AB_1$ through $AB_4$ formed respectively for monetary denominations are connected to respective differential amplifiers 1, 11, 12 and 13. The bridge circuits have a sorting coil Lo commonly, that is, each bridge circuit has the sorting coil Lo as or one side leg. The outputs of the differential amplifiers 1, 11, 12 and 13 are connected to the inputs of comparison circuits 3, 31, 32 and 33, respectively, the outputs of which are connected directly to a sorting circuit means 5. The AC output of an oscillation source Wo for the bridge circuits is connected to the sorting circuit means 5 through a waveform converting circuit 6 such as a Schmitt trigger circuit. The waveform converting circuit 6 is to obtain a reference pulse signal CP having the same period as that of the frequency of the AC signal of the oscillation source, by converting the AC signal into a square wave having binary values. However, the circuit 6 is not always necessary and the AC output may be connected directly to the sorting circuit means 5. In this sorting circuit means 5, sorting circuits are provided in correspondence to the number of monetary denominations. In this embodiment, the outputs of the bridge circuits $AB_1$ through $AB_4$ are amplified by the differential amplifiers 1, 11, 12 and 13 and are applied to the comparison circuits 3, 31, 32 and 33, respectively, where the outputs thus amplified are compared with a reference voltage, as a result of which bridge output pulse train signals in the form of alternating square waves having binary values (hereinafter referred to as "pulse train signals", when applicable) are applied to the sorting circuit means 5. Shown in FIG. 4 are the waveforms of the output $V_1$ of the differential amplifier 1, the output $V_{30}$ of the comparison circuit 3, and the reference pulse CP in one denomination system. As is apparent from FIG. 4, the output $V_1$ of the differential amplifier 1 becomes a high, unbalanced voltage when the bridge circuit $AB_4$ is in an unbalanced state, and becomes zero when the bridge circuit $AB_4$ is in a balanced state. This output $V_1$ is compared with a reference voltage CV in the comparison circuit 3, and when the bridge circuit $AB_4$ is in an unbalanced state, the pulse train signal in the form of a square wave having binary codes and a period corresponding to the period of the AC signal of the oscillation source Wo is provided as the output $V_{30}$ of the comparison circuit 3. As the bridge circuit $AB_4$ is balanced, the peak value of the output $V_1$ of the differential amplifier 1 becomes 1 lower than the reference voltage CV, until finally an output $V_{30}$ representing one binary code is continuously provided. Thereafter, when the bridge circuit $AB_4$ is placed in an unbalanced state again, the comparison circuit 3 provides the output $V_{30}$ in the form of a pulse train signal again. Reference character $V_{30}$ in FIG. 4 indicates the inverted output of the comparison circuit. Receiving the output $V_{30}$ of the comparison circuit 3 and the reference pulse signal CP, the sorting circuit means determines the presence or absence of a sorting signal depending on whether or not the output $V_{30}$ of the comparison ciruit 3 has a negative state during one period of the reference pulse signal CP. In other words, when the bridge circuit $AB_4$ is in an unbalanced state, a certain period of time, during which the output $V_{30}$ of the comparison circuit 3 becomes negative, exists in one period of the reference pulse signal CP; on the other hand, when the bridge circuit $AB_4$ is placed in a balanced state, the period of time during which the output $V_{30}$ of the comparison circuit 3 becomes negative is not included in one period of the reference pulse signal. Thus, the presence or absence of the sorting signal can be determined every period of the reference pulse signal CP. The sorting circuit means 5 subjects the reference pulse signal CP and the output $V_{30}$ of the comparison circuit 3 to comparison, to thereby output a coin counting signal $C_1$ and a gate signal G for a coin receiving returning gate.

The sorting circuit means 5 will be described in more detail with reference to FIG. 5, which shows a circuit diagram of one sorting circuit which belongs to one of the monetary denomination systems. Accordingly, in the case where coins of four denominations, for instance, are handled, it is necessary to provide four of the sorting circuits shown in FIG. 5.

The sorting circuit, as shown in FIG. 5, comprises: an input terminal 10 to which the reference pulse signal CP is applied; flip-flops FF1 through FF5, the flip-flops FF1 and FF2 being D-type flip-flops, the flip-flops FF3 through FF5 being RS-type flip-flops; a NOR circuit NOR; an OR circuit OR; AND circuits $AD_1$ through $AD_6$; and a NOT circuit NOT.

The terminal 10 to which the reference pulse signal CP is applied is connected to the clock pulse input terminals T of the flip-flops FF1 and FF2. The output terminal Q of the flip-flop FF1 is connected to the terminal D of the flip-flop FF2 and to one terminal of the NOR circuit NOR, to the other input terminal of which the terminal Q of the flip-flop FF2 is connected. The output terminal of the NOR circuit NOR is connected to the input terminal D of the flip-flop FF1, and the output of the NOR circuit NOR is also applied, as a timing signal CS3, to a second input terminal of the AND circuit $AD_3$, to a second input terminal of the AND circuit $AD_5$, and to the set terminal S of the flip-flop FF3. The signal provided at the output terminal Q of the flip-flop FF1 is applied, as a timing signal $CS_1$, to a second input terminal of the AND circuit $AD_1$, to a second input terminal of the AND circuit $AD_6$, and to the set terminal S of the flip-flop FF4. The signal provided at the output terminal Q of the flip-flop FF2 is applied, as a timing signal $CS_2$, to a second input terminal of the AND circuit $AD_2$, to a second input terminal of the AND circuit $AD_4$, and to the set terminal S of the flip-flop FF5. The output $V_{30}$ of the comparison circuit 3, for instance, shown in FIG. 3, is applied to first input terminals of the AND circuits $AD_1$ through $AD_3$ through the NOT circuit NOT. The outputs of the AND circuits $AD_1$ through $AD_3$ are connected to the reset terminals R of the flip-flop circuits FF3 through FF5, respectively. The output terminals Q of the flip-flops FF3 through FF5 are connected to the first input terminals of the AND circuits $AD_4$ through $AD_6$, respectively, the outputs of which are connected to the input terminals of the OR circuit OR. The output of the OR circuit OR is connected to an output terminal OUT through which the coin counting signal or the gate signal for the gate adapted to segregate a true coin from a false coin (hereinafter referred to merely as "a sorting signal") are transmitted.

The operation of the sorting circuit shown in FIG. 5 will be described with reference to waveforms indicated in FIG. 6.

The reference pulse signal CP is formed as an alternating square wave pulse signal having the same period as that of the AC signal outputted by the oscillation source Wo of the bridge circuit, as indicated by CP in FIG. 6. The output $V_{30}$ of the comparison circuit 3 is provided in the form of an alternating square wave pulse signal whose period is equal to the period of the AC signal outputted by the oscillation source Wo when the bridge circuit is in an unbalanced state; on the other hand, the output $V_{30}$ is provided in the form of a signal whose level is maintained unchanged when the bridge circuit is placed in a balanced state. The waveform of the output $V_{30}$ is as indicated by $V_{30}$ in FIG. 6.

When the reference pulse signal CP is not applied to the clock pulse terminals T of the flip-flops FF1 and FF2 whereby logical signals "0" (hereinafter referred to merely as signals "0," or "0," when applicable) are applied through the output terminals Q of the flip-flops FF1 and FF2 to the input terminals of the NOR circuit NOR, the output of the NOR circuit NOR has a logical signal "1"0 (hereinafter referred to merely as a signal "1," or "1," when applicable) and, therefore, the signal "1" is applied to the input terminal D of the flip-flop FF1. When, under this condition, the first reference pulse signal $CP_1$ is applied to the clock pulse terminal T of the flip-flop FF1, the signal "1" is provided at the output terminal Q of the flip-flop FF1. The first reference pulse signal $CP_1$ is applied also to the clock pulse terminal T of the flip-flop FF2; however, the output of the flip-flop FF2 is maintained at "0" because the signal "0" has been applied to the input terminal D thereof. When the signal "1" is provided at the output terminal Q of the flip-flop FF1 as was described above, the output of the NOR circuit NOR is switched from "1" to "0" and, therefore, the signal "0" is applied to the input terminal D of the flip-flop FF1. If, when the signals "0" and "1" are applied to the input terminals D of the flip-flops FF1 and FF2, respectively, the second reference pulse signal $CP_2$ is applied to the clock pulse terminals T of the flip-flops FF1 and FF2, then the signal "0" is provided at the output terminal Q of the flip-flop FF1, while the signal "1" is provided at the output terminal Q of the flip-flop FF2. For the period of time from the occurrence of the first reference pulse signal $CP_1$ till the occurrence of the second reference pulse signal CP2, the signal "1" is maintained at the output terminal Q of the flip-flop FF1. This signal "1" is delivered as the timing signal $CS_1$ ($CS_1$ in FIG. 6). With the aid of the second reference pulse signal $CP_2$, the output of the flip-flop FF1 is changed to "0," while the output of the flip-flop FF2 is changed to "1." Therefore, the output of the NOR circuit NOR is still "0."

When the third reference pulse signal $CP_3$ is applied to the clock pulse terminals T of the flip-flops FF1 and FF2, the "0" at the output terminal Q of the flip-flop FF1 is not changed; however, the signal "0" is provided at the output terminal Q of the flip-flop FF2. As is apparent from the above description, for the period of time from the occurrence of the second reference pulse signal $CP_2$ to the occurrence of the third reference pulse signal $CP_3$, the signal "1" is maintained at the output terminal Q of the flip-flop FF2. This signal "1" is delivered as the timing signal $CS_2$ ($CS_2$ in FIG. 6). When the third referencce pulse signal is applied to the flip-flops FF1 and FF3, the signals "0" are applied to the input terminals of the NOR circuit NOR, and therefore the output of the NOR circuit NOR is changed to "1."

When the fourth reference pulse signal $CP_4$ is applied to the clock pulse terminals T of the flip-flops FF1 and FF2, the signal "1" is provided at the output terminal Q of the flip-flop FF1, and the signal "0" is still maintained at the output terminal Q of the flip-flop FF2. Accordingly, the output of the NOR circuit NOR is changed to "0." Thus, during the period of time from the occurrence of the third reference pulse signal $CP_3$ to the occurrence of the fourth reference pulse signal $CP_4$, the signal "1" is continuously maintained at the output of the NOR circuit NOR. This signal "1" is delivered as the timing signal $CS_3$ ($CS_3$ in FIG. 6).

The operations of the flip-flops FF1 and FF2 and the NOR circuit NOR effected after application of the fourth reference pulse signal $CP_4$ are similar to those of the flip-flops FF1 and FF2 and the NOR circuit NOR effected after application of the first reference pulse signal $CP_1$. The operations of the flip-flops FF1 and FF2 and the NOR circuit NOR effected after application of the fifth reference pulse signal $CP_5$ is similar to those of the flip-flops FF1 and FF2 and the NOR circuit NOR effected after application of the second reference pulse signal $CP_2$. Thus, the timing signals $CS_1$, $CS_2$ and $CS_3$ are repeatedly produced one after another in synchronization with the period of the reference pulse train signal CP by the circuit made up of the flip-flops FF1 and FF2 and the NOR circuit NOR.

When a coin is not yet passed through the sorting coil Lo, the bridge circuit is in an unbalanced state, and the output $V_{30}$ of the comparison circuit 3 is an alternating square wave pulse signal whose period is equal to the period of the reference pulse train signal CP. Therefore, the "0" level state of the output $V_{30}$ occurs, without fail, during the period of each of the timing signals $CS_1$, $CS_2$ and $CS_3$, that is, one period of the reference pulse train signal CP. The flip-flop FF4 is set by the timing signal $CS_1$, as a result of which the signal "1" is applied through its output terminal Q to the first input terminal of the AND circuit $AD_5$; however, the AND condition of the AND circuit $AD_5$ is not satisfied because the timing signal $CS_3$ is not applied thereto yet. Next, the flip-flop FF5 is set by the timing signal $CS_2$, so that the signal "1" is applied to the first input terminal of the AND circuit $AD_6$; however, the AND condition of the AND circuit $AD_6$ is not satisfied because the timing signal $CS_1$ in not provided yet. On the other hand, the AND condition of the AND circuit $AD_2$ which receives the timing signal $CS_2$ and the signal obtained by inverting the output $V_{30}$ of the comparison circuit 3 is satisfied as soon as the level of the output $V_{30}$ is switched to the negative "0" level, to thereby apply the signal "1" to the reset terminal R of the flip-flop FF4. As a result, the signal "0" is provided at the output terminal Q of the flip-flop FF4, and before the timing signal $CS_3$ is produced, the signal "0" is applied to the first input terminal of the AND circuit $AD_5$. Upon provision of the timing signal $CS_3$, the flip-flop FF3 is set and, therefore, the signal "1" is applied to the first input terminal of the AND circuit $AD_4$; however, the AND condition of the AND circuit $AD_4$ is not satisfied because the timing signal $CS_2$ is not provided yet at this instant. The AND condition of the AND circuit $AD_3$ which receives the timing signal $CS_3$ and the signal obtained by inverting the output $V_{30}$ of the comparison circuit 3 is satisfied immediately when the output $V_{30}$ is lowered to the negative "0" level, to thereby reset the flip-flop FF5. Thus, before the timing signal $CS_1$ is applied to the AND circuit $AD_6$, the signal "0" is applied to the one input terminal of the AND circuit $AD_6$. When the timing signal $CS_1$ is provided again after the timing signal $CS_3$, the flip-flop FF4 is set. On the other hand, when the level of the output $V_{30}$ is switched to the negative "0" level, the AND circuit $AD_1$ is rendered conductive, as a result of which the flip-flop FF3 is reset. After the flip-flop FF3 has been reset, the signal "0" is applied to the first input terminal of the AND circuit $AD_4$ before the timing signal $CS_2$ is applied thereto. The flip-flops FF3 through FF5 are set by the preceding timing signals, and are reset when the output $V_{30}$ of the comparison circuit 3 becomes the negative "0" level with the aid of the succeeding timing signals. In other words, the output $V_{30}$ of the comparison circuit 3 is checked every period of the reference pulse signal CP, and when the bridge circuit is in an unbalanced state, the set and reset states of the flip-flops FF3 through FF5 are repeatedly provided.

When, as indicated by $V_{30}$ in FIG. 6, the output $V_{30}$ of the comparison circuit 3 becomes a signal "1" whose level is continuously maintained constant, that is, the bridge circuit becomes balanced so that the bridge output is lower than the reference voltage CV, the flip-flop FF5 which has been set by the timing signal $CS_2$ will not be reset by the timing signal $CS_3$. After the flip-flop FF5 has been set by the timing signal $CS_2$, the output $V_{30}$ of the comparison circuit 3 is maintained at the "1" level. Therefore, the AND condition of the AND circuit $AD_3$ which receives the signal obtained by inverting the output $V_{30}$ and the timing signal $CS_3$ is not satisfied, and therefore no reset input signal is applied to the flip-flop FF5. Accordingly, the signal "1" is continuously applied from the output terminal Q of the flip-flop FF5 to the first input terminal of the AND circuit $AD_6$ until the timing signal $CS_3$ and the "0" level signal of the output $V_{30}$ occur in coincidence with each other ($S_3$ in FIG. 6). The flip-flop FF3 has been set by the timing signal $CS_3$. Thereafter, upon production of the timing signal $CS_1$, the AND condition $AD_6$ is satisfied, and therefore the output "1" as indicated by $S_{30}$ in FIG. 6 is provided by the AND circuit $AD_6$. This output "1" is applied through the OR circuit OR to the output terminal OUT. The AND circuit $AD_1$ which receives the timing signal $CS_1$ is not rendered conductive because the output $V_{30}$ is at the "1" level during the period of the timing signal $CS_1$. Accordingly, the flip-flop FF3 is maintained set, and the signal "1" is continuously applied from the output terminal Q of the flip-flop FF3 to the first input terminal of the AND circuit $AD_4$ until the flip-flop FF3 is reset ($S_1$ in FIG. 6). The flip-flop FF4 has been set by the timing signal $CS_1$.

After the timing signal $CS_1$ has been eliminated, the timing signal $CS_2$ is provided. As a result, the AND circuit $AD_4$ is rendered conductive for the period of the timing signal $CS_2$, and therefore the output "1" of the AND circuit $AD_4$ as indicated by $S_{20}$ in FIG. 6 is applied through the OR circuit OR to the output terminal OUT. The AND condition of the AND circuit $AD_2$ which receives the timing signal $CS_2$ through its first input terminal and the output $V_{30}$ through its second input terminal is not satisfied because the output $V_2$ is at the "1" level. Therefore, the flip-flop FF4 is not reset; that is, it is maintained set for the period of time which elapses from the instant it is set by the timing signal $CS_1$ until the "0" level signal is provided in the output $V_{30}$ during the period in which the timing signal $CS_2$ is provided, as indicated by $S_2$ in FIG. 6. When the timing signal $CS_3$ is provided with the flip-flop FF4 set, the AND circuit $AD_5$ is rendered conductive for the period of time during which the timing signal $CS_3$ is provided. Thus, the OR circuit OR outputs the sorting signal as indicated by $S_J$ in FIG. 6.

Then, the state of the bridge circuit is changed from the balanced state to the unbalanced state again as result of which the output $V_{30}$ of the comparison circuit 3 maintained at the "1" is changed to the alternating square wave signal including the "1" and "0" signals. In this case, the timing signal $CS_3$ is produced at the instant when the output $V_{30}$ is switched to the "0" level, and therefore the AND condition of the AND circuit $AD_3$ is satisfied, so as to reset the FF5.

As the output $V_{30}$ is switched to the "0" level during the period of the timing signal $CS_1$, the AND circuit $AD_1$ is rendered conductive to reset the flip-flop FF3. With the aid of the timing signal $CS_2$ provided after the timing signal $CS_1$ and the "0" level of the output $V_{30}$, the AND circuit $AD_2$ is rendered conductive to reset the flip-flop FF4. Thereafter, the flip-flops FF3 through FF5 are set and reset one after another in synchronization with the period of the reference pulse train signal with the aid of the timing signals $CS_1$ through $CS_3$ and the output $V_{30}$, or the pulse train signal in the form of an alternating square wave.

As is apparent from the above description, according to the invention, the AC frequency of the oscillation source for the bridge circuit is employed as the reference pulse train signal, the outputs of the bridge circuits which are not rectified and smoothed are compared with the reference voltage in the comparison circuits, and the outputs of the comparison circuits are compared with the reference pulse signal, whereby it is determined that a bridge circuit has been balanced. Accordingly, the invention has the advantage that the rectifying and smoothing circuit in the analog circuit which is disadvantageous in miniaturization and high in cost can be eliminated.

Figure 7:
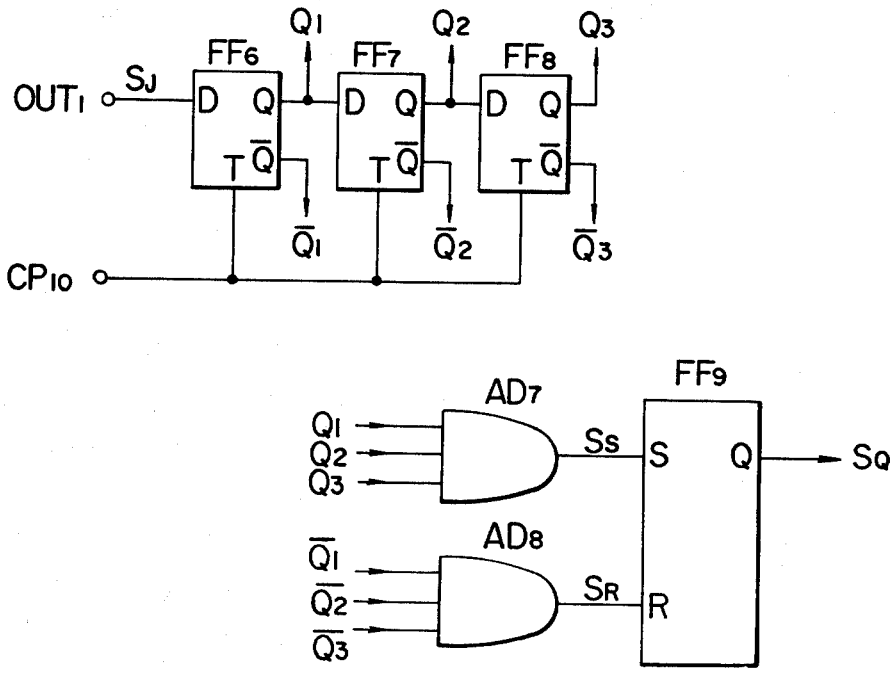
FIG. 7 is a circuit diagram of a hysteresis circuit which may be used with the circuit of FIG. 5.

In order to prevent false coin indications, a hysteresis effect may be provided for both the commencement and termination of the coin sorting signal using the circuit shown in FIG. 7.

In FIG. 7, reference character $OUT_1$ is a terminal connected to the output terminal OUT in FIG. 5; reference characters FF6 through FF9, flip-flops, the flip-flops FF6 through FF8 being D-type flip-flops, the flip-flop FF9 being an RS-type flip-flop; reference characters $AD_7$ and $AD_8$, AND circuits; and $CP_{10}$, an input terminal of the reference pulse train signal.

The terminal $OUT_1$ is connected to the input terminal D of the flip-flop FF6. The output terminal Q of the flip-flop FF6 is connected to the input terminal D of th flip-flop FF7, the output terminal Q of which is connected to the input terminal D of the flip-flop FF8. The input terminal $CP_{10}$ is connected to the clock pulse terminals T of the flip-flops FF6 through FF8. The output terminals $\overline{Q}$ of the flip-flops FF6 through FF8 are connected to the input terminals of the AND circuit $AD_7$, while the output terminals Q of the flip-flops FF6 through FF8 are connected to the input terminals of the AND circuit $AD_8$, respectively. The output terminal of the AND circuit $AD_7$ is connected to the set terminal S of the flip-flop FF9, and the output terminal of the AND circuit $AD_8$ is connected to the reset terminal R of the flip-flop FF9.

The operation of the circuit shown in FIG. 7 will be described with reference to waveforms shown in FIG. 8.

Figure 8:
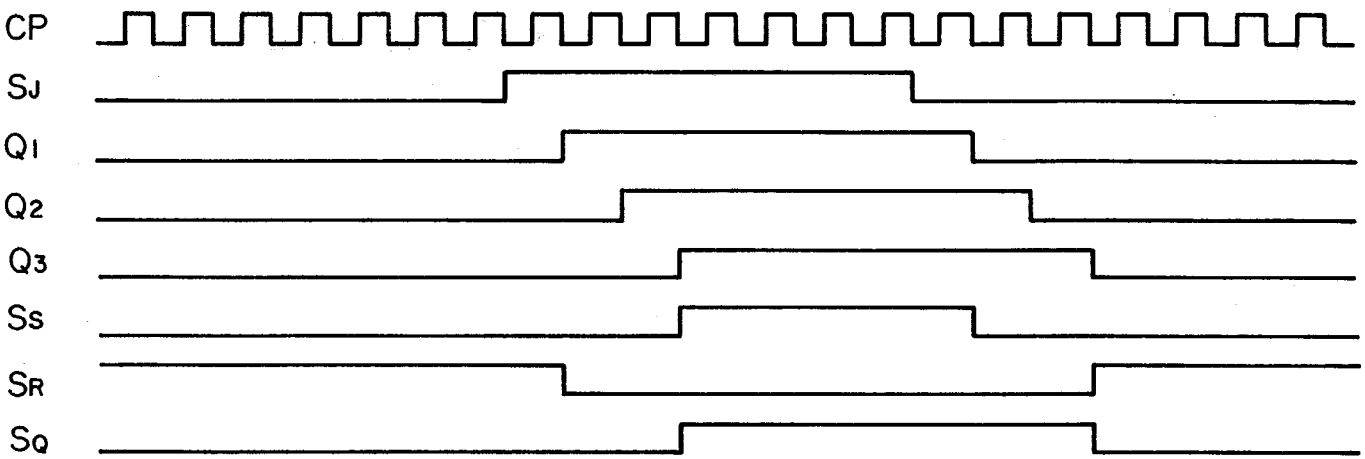
FIG. 8 contains waveform diagrams illustrating the operation of the circuit FIG. 7.

The reference pulse train signal CP applied through the input terminal $CP_{10}$ to the clock pulse terminals T of the flip-flops FF6 through FF8 is an alternating square wave signal whose period is equal to the period of the AC signal produced by the oscillation source provided for the bridge circuit, as indicated by CP in FIG. 8. A signal SJ (indicated in FIG. 8) is the sorting signal outputted through the output terminal OUT in FIG. 5. When the sorting signal SJ applied through the terminal $OUT_1$ to the flip-flop FF6 is at the "0," the output "0" at the output terminal Q thereof is maintained unchanged even if the reference pulse train signal CP is applied to the clock pulse terminal T of the flip-flop FF6. The signal "1" is outputted at the output terminal Q of the flip-flop FF6 by the reference pulse train signal CP which occurs firstly after the signal SJ applied to the input terminal D of the flip-flop FF6 has been changed to "1." As a result, the signal "1" is applied to the input terminal D of the flip-flop FF7. Therefore, the signal "1" is provided at the output terminal Q of the flip-flop FF7 with the aid of the reference pulse train signal which occurs secondly after the signal SJ has been changed to "1." Thus, the signal "1" is applied to the input terminal D of the flip-flop FF8. Similarly, the signal "1" is provided at the output terminal Q of the flip-flop FF8 with the aid of the reference pulse train CP which occurs thirdly after the signal SJ has been changed to "1." The signal SJ is maintained at "1" until the signal "1" is provided at the output terminal Q of the flip-flop FF8. Therefore, the output terminals of the flip-flops FF6 and FF7 are maintained at "1." Accordingly, as soon as the signal "1" is provided at the output terminal Q of the flip-flop FF8, the AND condition of the AND circuit AD7 is satisfied, as a result of which the flip-flop FF9 is set to provide the signal "1" at the output terminal Q thereof (cf. SQ in FIG. 8). In this operation, the signals "0" are outputted at the output terminals $\overline{Q}$ of the flip-flops FF6 through FF8, and therefore the AND circuit $AD_8$ is not rendered conductive.

Thereafter, the level of the signal SJ is changed from "1" to "0." In this case, the signals "0" and "1" are provided respectively at the output terminals Q and $\overline{Q}$ of the flip-flop FF6 by the reference pulse train signal which occurs firstly after the level of the signal SJ has been switched from "1" to "0," and therefore the signal "0" is applied from the output terminal Q to the input terminal D of the flip-flop FF7. Accordingly, the signals "0" and "1" are provided respectively at the output terminals Q and $\overline{Q}$ of the flip-flop FF7 with the aid of the reference pulse train signal which occurs secondly after the signal SJ has been switched from "1" to "0." Similarly, the signals "0" and "1" are provided at the output terminals Q and $\overline{Q}$ of the flip-flop FF8, respectively, by the reference pulse train signal CP which occurs thirdly after the signal SJ has been switched to "0" from "1." In this case, the signal SJ has been maintained at "0" since it was changed from "1" to "0." Therefore, the signals "1" are maintained at the output terminals $\overline{Q}$ of the flip-flops FF6 and FF7. Accordingly, when the signal "1" is provided at the terminal $\overline{Q}$ of the flip-flop FF8, the AND condition of the AND circuit $AD_8$ is satisfied, so that the reset signal is applied to the flip-flop FF9, to reset the latter. As a result, the signal "0" is provided at the output terminal Q of the flip-flop FF9.

In this embodiment, when, after production of the sorting signal SJ has been continued for three periods of the reference pulse train signal, elimination of the sorting signal SJ is continued for three periods of the reference pulse train signal, and the presence or absence of the sorting is determined. Therefore, it is possible to give an analog voltage hysteresis to the comparison circuit, and furthermore it is possible to give the same effect as that of voltage hysteresis to the comparison circuit even when the signal SJ is produced. The above-described embodiment is so designed that, when the signal SJ is produced and then eliminated, it is detected whether or not these two states of the signal SJ are continuously maintained for the same periods of the reference pulse train signal. However, the length of the periods of the reference pulse train signal during which the continuous states should be maintained unchanged can be varied, for instance, in such a manner that it is detected if production of the signal SJ is continued for two periods of the reference pulse train signal and if elimination of the signal SJ is continued for three periods of the same.

As is clear from the above description, according to the invention the device can be provided in which the rectifying and smoothing circuit, that is, an expensive analog circuit which is disadvantageous in miniaturization, can be eliminated, and in which an analog voltage hysteresis can be provided, and yet the same effect as that of the voltage hysteresis can be provided even at the commencement of the sorting signal.

What is claimed is:

1. A coin sorting machine of the type in which an A.C. excitation signal is applied to a bridge circuit having a sorting coil whose impedance is varied by the passage of a coin and a standard impedance element having an impedance corresponding to a particular coin denomination, the output signal of said bridge, when said bridge is balanced, indicating the passage of a coin of said particular denomination, wherein the improvement comprises:

clock means for continuously providing a periodically varying clock signal;

first comparison means for comparing the output from said bridge circuit to a reference voltage and providing a first comparison output signal in the form of a binary pulse train which periodically alternates between first and second binary values with a period equal to at least one period of said clock signal when said bridge circuit is unbalanced and which remains at said first binary value when said bridge circuit is balanced; and second comparison means for comparing said clock signal and said first comparison output signal and producing a coin sorting signal only when said second binary value of said first comparison output signal does not occur within a predetermined period having a duration equal to at least one period of said clock signal.

2. A coin sorting machine according to claim 1, wherein said second comparison means determines that said bridge circuit is unbalanced and terminates said coin sorting signal when said second binary value occurs during a successive number of periods of said clock signal.

3. A coin sorting machine according to claim 2, wherein said predetermined period is longer than one period of said clock signal and said successive number is more than one.

4. A coin sorting machine according to claims 1, 2 or 3, wherein the period of said clock signal is equal to the period of said excitation signal.

5. A coin sorting machine according to claim 4, wherein said clock means is a Schmitt trigger which receives said excitation signal and provides a square wave clock signal.

* * * * *